US006744191B2

(12) United States Patent
Oda et al.

(10) Patent No.: US 6,744,191 B2
(45) Date of Patent: Jun. 1, 2004

(54) CATHODE RAY TUBE INCLUDING AN ELECTRON GUN WITH SPECIFIC MAIN LENS SECTION

(75) Inventors: Hiroyuki Oda, Fukaya (JP); Junichi Kimiya, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 118 days.

(21) Appl. No.: 09/995,606

(22) Filed: Nov. 29, 2001

(65) Prior Publication Data

US 2002/0063538 A1 May 30, 2002

(30) Foreign Application Priority Data

Nov. 30, 2000 (JP) ..... 2000-365927

(51) Int. Cl.[7] ..... H01J 3/18
(52) U.S. Cl. ..... 313/414; 313/412; 315/382
(58) Field of Search ..... 313/414, 412, 313/413, 409, 448, 449; 315/15, 382

(56) References Cited

U.S. PATENT DOCUMENTS 6,100,630 A * 8/2000 Amano et al. ..... 313/414
6,313,575 B1 * 11/2001 Kimiya et al. ..... 313/414

FOREIGN PATENT DOCUMENTS

| | | |
|---|---|---|
| JP | 61-99249 | 5/1986 |
| JP | 4-160739 | 6/1992 |
| JP | 9-320485 | 12/1997 |

* cited by examiner

*Primary Examiner*—Ashok Patel
*Assistant Examiner*—Karabi Guharay
(74) *Attorney, Agent, or Firm*—Oblon, Spivak, McClelland, Maier & Neustadt, P.C.

(57) ABSTRACT

A main lens section of an electron gun assembly comprises a fifth grid supplied with a focus voltage, a sixth grid supplied with a dynamic focus voltage, a first intermediate electrode, a second intermediate electrode, and a seventh grid. The main lens section includes an electric field lens acting commonly on the electron beams on a focus region side of the main lens section, which is formed by the fifth grid, sixth grid and first intermediate electrode, and a plurality of electric field lenses acting respectively on the electron beams on a divergence region side of the main lens section, which is formed by the second intermediate electrode and seventh grid.

14 Claims, 4 Drawing Sheets

CATHODE RAY TUBE INCLUDING AN ELECTRON GUN WITH SPECIFIC MAIN LENS SECTION

CROSS-REFERENCE TO RELATED APPLICATIONS

This application is based upon and claims the benefit of priority from the prior Japanese Patent Application No. 2000-365927, filed Nov. 30, 2000, the entire contents of which are incorporated herein by reference.

BACKGROUND OF THE INVENTION

1. Field of the Invention

The present invention relates generally to a cathode ray tube (CRT) apparatus, and more particularly to a color cathode ray tube apparatus equipped with an in-line electron gun assembly for emitting three electron beams travelling in the same horizontal plane.

2. Description of the Related Art

In recent years, a self-convergence in-line type color cathode ray tube apparatus has widely been put to practical use. This CRT apparatus is characterized in that three in-line electron beams are self-converged on the entire area of a phosphor screen.

In this type of color CRT apparatus, a method of increasing a lens aperture of a main lens section created by an electron gun assembly is effective as means for obtaining good image characteristics. Typical means for increasing the lens aperture of the main lens section are an overlapping field type lens and an extended field type lens.

As is shown in FIG. 1, an overlapping field type lens 52 is created between two adjacent electrodes 50*a* and 50*b*, which have outer peripheral electrodes 51*a* and 51*b* at their opposing faces. The overlapping field type lens 52 is an electric field lens acting commonly on three electron beams passing through three electron beam passage holes formed in each of the electrodes 50*a* and 50*b*. Thereby, the lens diameter of the main electric filed is substantially increased.

As is shown in FIG. 2, an extended field type lens 65 is created by disposing an intermediate electrode 62 between a focus electrode 61 and an anode 63. A focus voltage is applied to the focus electrode 61, an anode voltage higher than the focus voltage is applied to the anode 63, and a voltage of an intermediate level between the focus voltage and anode voltage is applied to the intermediate electrode 62. In general, in consideration of breakdown voltage characteristics, a voltage obtained by resistor-dividing the anode voltage via a resistor 64 is applied to the intermediate electrode 62. The extended field type lens 65 increases the lens diameter by extending the lens region in the tube axis direction.

Jpn. Pat. Appln. KOKAI Publication No. 9-320485, for instance, discloses that two lenses are combined to obtain more improved image characteristics.

On the other hand, the effect of deflection magnetic fields upon electron beams cannot be ignored. In the color CRT apparatus, electron beams, which have passed through non-uniform magnetic fields, are affected by deflection aberration components included in the deflection magnetic fields. Consequently, a beam spot deforms on a peripheral portion of the phosphor screen, and the resolution considerably deteriorates.

An electron beam 12 deflected onto a peripheral portion of the phosphor screen is affected by a force exerted by a pincushion type horizontal deflection magnetic field 11 in the direction of arrows 13, as shown in, e.g. FIG. 3A. As a result, as shown in FIG. 3B, the beam spot on the peripheral portion of the phosphor screen horizontally deforms, and the resolution greatly deteriorates.

The electron beam affected by the deflection aberration components is horizontally enlarged and vertically over-focused. The beam spot formed on the peripheral portion of the phosphor screen thus produces a high-luminance core portion 14 deformed in a horizontal direction X and a low-luminance halo portion 15 enlarged in a vertical direction Y.

Jpn. Pat. Appln. KOKAI Publication No. 61-99249, for instance, discloses structural means for solving the problem of deterioration in resolution. The electron gun assembly in this structural means basically comprises first to fifth grids. The electron gun assembly also includes an electron beam generating section, a quadrupole lens and a main lens, which are disposed in the direction of travel of electron beams. The third and fifth grids disposed adjacent to each other to create the quadrupole lens have, respectively, vertically and horizontally elongated non-circular electron beam passage holes in their mutually opposing faces.

The lens function of the quadrupole lens dynamically is varied by applying a dynamic focus voltage that varies in synchronism with deflection magnetic fields to the fourth grid. Thus, the quadrupole lens corrects the deformation due to deflection aberration of the electron beam deflected on the peripheral portion of the phosphor screen.

If the quadrupole lens is combined with the above-mentioned two lenses (overlapping field type lens and extended field type lens), good image characteristics can be obtained over the entire area of the screen.

The overlapping field type lens can increase the horizontal lens diameter relative to the electron beams, but it cannot increase the vertical lens diameter as much as the horizontal lens aperture. This results in a difference in lens diameter between the horizontal and vertical directions, and the focal distance in the vertical direction becomes shorter than that in the horizontal direction. Thus, this overlapping field type lens has a negative astigmatism. The electron beam, which has passed through the overlapping field type lens, is horizontally under-focused and vertically over-focused. In order to compensate the negative astigmatism, one of the electrodes which is arranged back from the overlapping field type lens is generally provided with vertically elongated electron beam passage holes.

However, this electrode structure makes the horizontal dimension of the electron beam passage hole less than the vertical dimension thereof. Consequently, the distance between the electron beam and the horizontal end portions of the electron beam passage hole in the electrode decreases, and local aberration occurs. In practice, even if the length of the outer peripheral electrode is to be extended in the tube axis direction to realize a large-aperture lens, the above-mentioned horizontal local aberration restricts the length of the outer peripheral electrode and makes it difficult to obtain a desired lens aperture.

The combination of the above-mentioned quadrupole lens and the extended field type lens will now be considered.

In an electron gun assembly as shown in FIG. 4, a quadrupole lens is formed between a first focus electrode 803 and a second focus electrode 804 to which a dynamic focus voltage is applied. The first focus electrode 803, second focus electrode 804, an intermediate electrode 805 and an anode 806 constitute an extended field type main lens. The intermediate electrode 805 is supplied with a voltage from the anode 806 via a resistor 807.

In this structure, if a dynamic focus voltage is applied to the second focus electrode 804, part of the AC component of the dynamic focus voltage is superimposed on the intermediate electrode 805 due to the electrostatic capacitance created among the second focus electrode 804, intermediate electrode 805 and anode 806. Thus, the potential of the intermediate electrode 805 increases.

As is shown in FIG. 5, a potential Vf of the second focus electrode, a potential Vgm of the intermediate electrode and a potential Eb of the anode are set to become higher in the named order. When an AC component of the dynamic focus voltage is not applied to the second focus electrode, the extended field type main lens has a potential distribution 904. When an AC component of the dynamic focus voltage has been applied to the second focus electrode and a part of the AC component of the dynamic focus voltage is not superimposed on the intermediate electrode, the extended field type main lens has a potential distribution 905. When an AC component of the dynamic focus voltage has been applied to the second focus electrode and a part of the AC component of the dynamic focus voltage has been superimposed on the intermediate electrode, the extended field type main lens has a potential distribution 906.

Let us consider the position of the principal plane of the main lens, that is, the position of the center of the lens, in the respective potential distributions.

The principal plane of the main lens having the potential distributions 904 and 906 is at a position 907. On the other hand, the principal plane of the main lens having the potential distribution 905 is at a position 908 and slightly shifts to the phosphor screen side. Specifically, when a part of the AC component of the dynamic focus voltage is not applied to the intermediate electrode, the position of the principal plane of the main lens gradually moves to the phosphor screen side as the electron beam is deflected from the screen center toward the peripheral portion of the screen. On the other hand, when a part of the AC component of the dynamic focus voltage has been applied to the intermediate electrode, the position of the principal plane of the main lens remains substantially unchanged, even as the electron beam is deflected from the screen center toward the peripheral portion of the screen.

This behavior will now be considered referring to a simplified optical system shown in FIG. 6.

Assume that a position of a principal plane of the electron lens is S, a distance between an electron beam generating section I and the principal plane S is P, and a distance between the principal plane S and a phosphor screen O is Q. In this case, a magnification M of the electron lens is expressed by $$M=Q/P \tag{1}$$

In general terms, in the case of a color CRT apparatus, the distance between the electron beam generating section and the phosphor screen is longer at the peripheral portion of the screen than at the central portion of the screen. Assuming that the difference in distance between the peripheral portion of the screen and the central portion of the screen is $\alpha$ and the magnification M of the electron lens at the central portion of the screen is given by equation (1), a magnification M1 of the electron lens at the time the position of the principal plane is unchanged (at the time part of the AC component of the dynamic focus voltage has been superimposed on the intermediate electrode) is expressed, based on equation (1), by $$M1=(Q+\alpha)/P \tag{2}$$

It is thus understood that the lens magnification is greater at the peripheral portion of the screen than at the central portion of the screen and the electron beam diameter increases. On the other hand, a magnification M2 of the electron lens at the time the position of the principal plane has shifted to the phosphor screen side by $\beta$ (at the time part of the AC component of the dynamic focus voltage is not superimposed on the intermediate electrode) is expressed by $$M2=(Q+\alpha-\beta)/(P+\beta) \tag{3}$$

Compared to equation (2), the magnification decreases. It is thus understood that at the peripheral portion of the screen, the magnification decreases as the position of the principal plane shifts to the phosphor screen side and the electron beam diameter decreases.

In the electron gun assembly formed by combining the extended field type lens and quadrupole lens, the main lens diameter can be increased and the electron beam diameter at the peripheral portion of the screen can be improved. In practice, however, part of the AC component of the dynamic voltage is superimposed on the intermediate electrode due to the electrostatic capacitance among the electrodes and it is difficult to shift the principal plane of the main lens to the phosphor screen side.

BRIEF SUMMARY OF THE INVENTION

The present invention has been made in consideration of the above problem, and its object is to provide a cathode ray tube apparatus having an electron gun assembly capable of obtaining good image characteristics over the entire area of a phosphor screen.

In order to achieve the object, the present invention may provide a cathode ray tube apparatus comprising: an electron gun assembly having an electron beam generating section which generates a plurality of electron beams and a main lens section which focuses the electron beams generated from the electron beam generating section on a phosphor screen; and a deflection yoke which produces a deflection magnetic field that deflects the electron beams emitted from the electron gun assembly in a horizontal direction and a vertical direction, wherein the main lens section comprises a focus electrode supplied with a focus voltage of a first level, at least one intermediate electrode supplied with a voltage of a second level equal to or higher than the first level, and an anode supplied with an anode voltage of a third level higher than the second level, the focus electrode, at least one intermediate electrode and the anode being arranged in a direction of travel of the electron beams, and the main lens section includes an electric field lens acting commonly on the electron beams on a focus region side of the main lens section, which is formed by the focus electrode and at least one intermediate electrode, and a plurality of electric field lenses acting respectively on the electron beams on a divergence region side of the main lens section, which is formed by at least one intermediate electrode and the anode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A cathode ray tube (CRT) apparatus according to an embodiment of the present invention will now be described with reference to the accompanying drawings.

Figure 1:
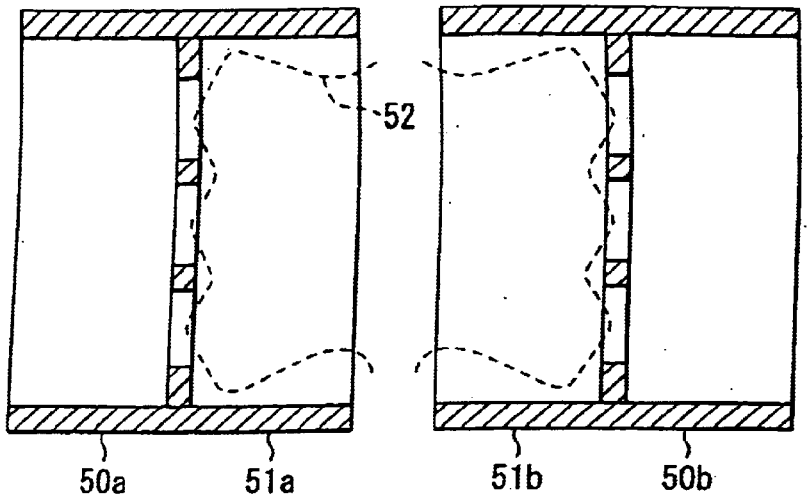
FIG. 1 (PRIOR ART)
FIG. 1 schematically shows the structure of an overlapping field type lens applied to an electron gun assembly.
Figure 2:
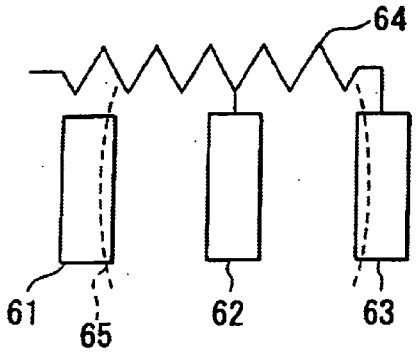
FIG. 2 schematically shows the structure of an extended field type lens applied to an electron gun assembly.
Figure 3A:
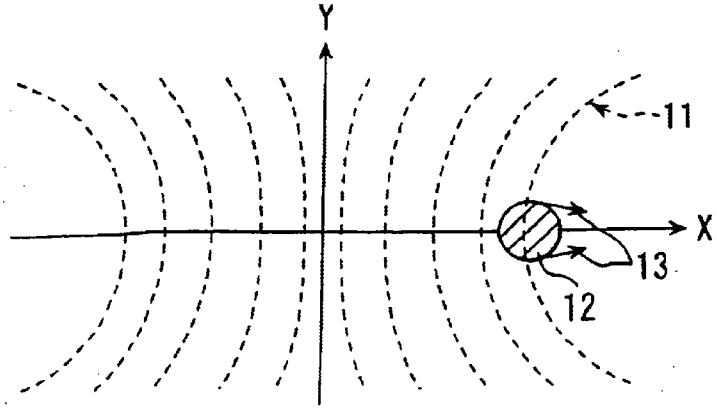
FIG. 3A (PRIOR ART)
FIGS. 3A and 3B illustrate deformation of a beam spot due to non-uniform magnetic fields.
Figure 3B:
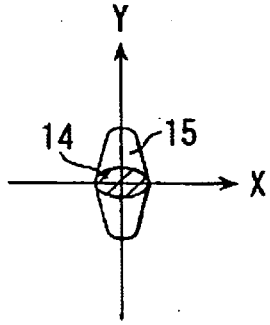
FIG. 3B (PRIOR ART)
Figure 4:
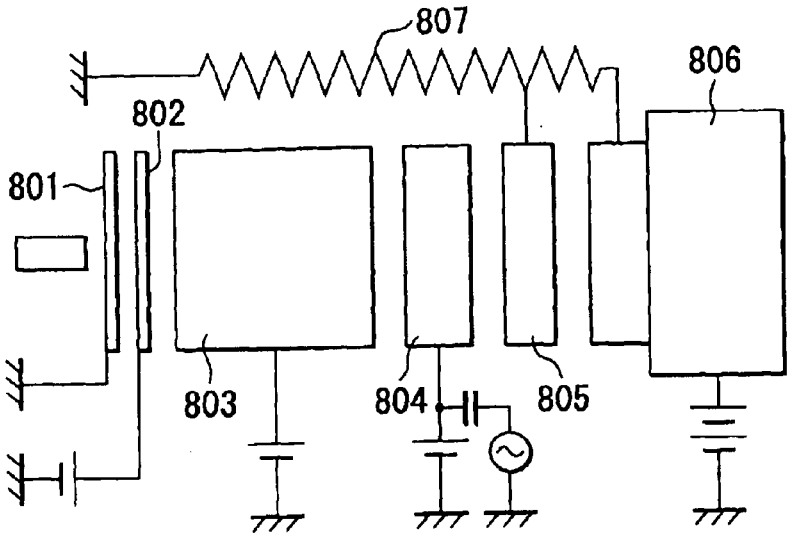
FIG. 4 (PRIOR ART)
FIG. 4 schematically shows the structure of a conventional electron gun assembly in which an extended field type main lens and a quadrupole lens are combined.
Figure 5:
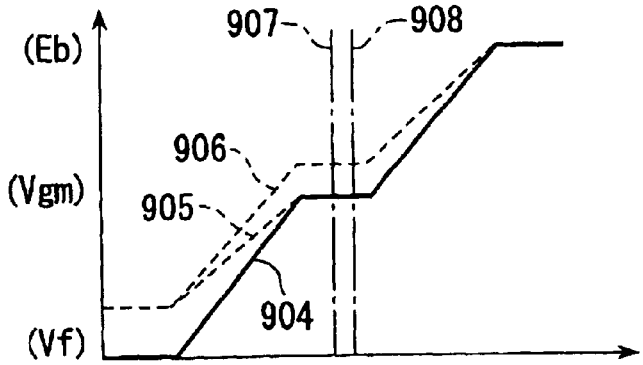
FIG. 5 (PRIOR ART)
FIG. 5 shows potential distributions of a main lens section and the position of the principal plane of the main lens section in the conventional electron gun assembly shown in FIG. 4.
Figure 6:
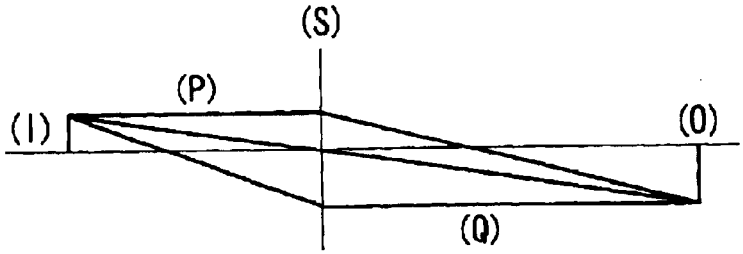
FIG. 6 shows an optical system for explaining the magnification of the main lens.
Figure 7:
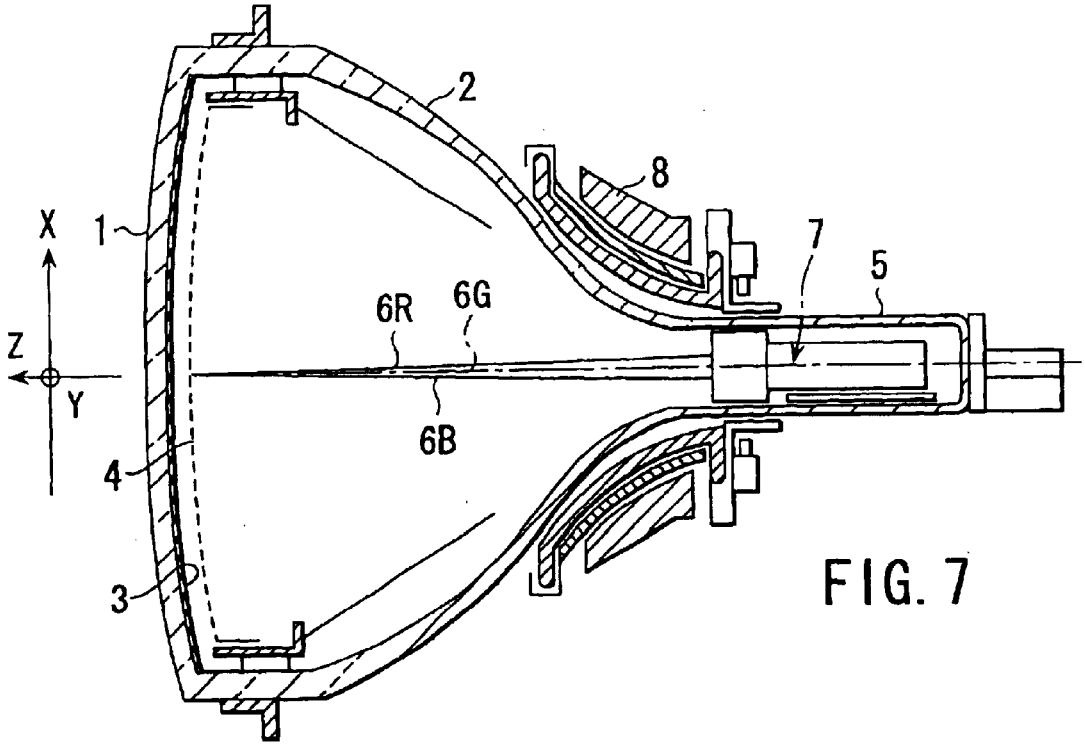
FIG. 7 is a horizontal cross-sectional view schematically showing the structure of a color CRT apparatus according to an embodiment of the present invention.

As is shown in FIG. 7, the CRT apparatus, e.g. a color CRT apparatus, has a vacuum envelope including a panel 1 and a funnel 2 integrally coupled to the panel 1. A phosphor screen 3 is disposed on an inside surface of the panel 1. The phosphor screen 3 has three-color striped or dot-shaped phosphor layers, which emit blue (B), green (G) and red (R) light components. A shadow mask 4 is disposed to face the phosphor screen 3. The shadow mask 4 has many apertures in its inside part.

An in-line electron gun assembly 7 is disposed within a neck 5, which corresponds to a thinnest portion of the funnel 2. The in-line electron gun assembly 7 emits three electron beams 6B, 6G and 6R (i.e. a center beam 6G and side beams 6B and 6R), which are arranged in line in a horizontal direction X and travel in the same horizontal plane, in a tube axis direction Z. In the in-line electron gun assembly 7, center positions of side beam passage holes in a low-potential side grid and a high-potential side grid, which are parts of a main lens section, are made eccentric to each other. Thereby, the three electron beams are self-converged on a central portion of the phosphor screen 3.

A deflection yoke 8 is mounted on the outside of the funnel 2. The deflection yoke 8 generates non-uniform deflection magnetic fields for deflecting the three electron beams 6B, 6G and 6R, which have been emitted from the electron gun assembly 7, in the horizontal direction X and vertical direction Y. The non-uniform deflection magnetic fields comprise a pincushion-shaped horizontal deflection magnetic field and a barrel-shaped vertical deflection magnetic field.

The three electron beams 6B, 6G and 6R emitted from the electron gun assembly 7 are focused on the associated phosphor layers on the phosphor screen 3, while they are being self-converged toward the phosphor screen 3. The three electron beams 6B, 6G and 6R are scanned by the non-uniform deflection magnetic fields in the horizontal direction X and vertical direction Y of the phosphor screen 3. Thus, a color image is displayed.

Figure 8:
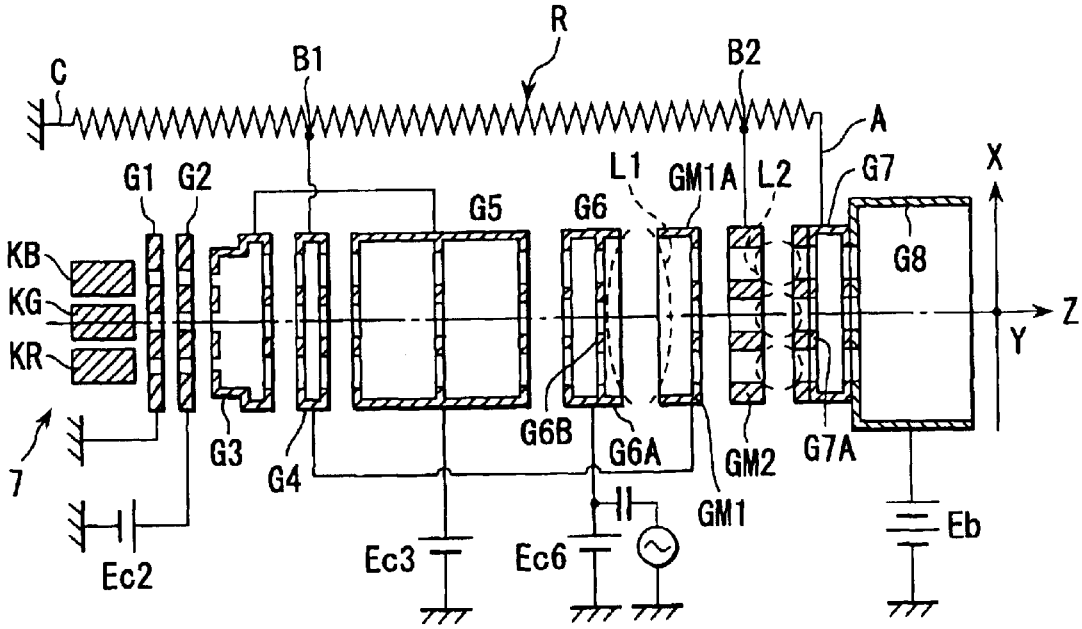
FIG. 8 is a horizontal cross-sectional view schematically showing the structure of an electron gun assembly applied to the CRT apparatus shown in FIG. 7.

The electron gun assembly 7 applied to the CRT apparatus, as shown in FIG. 8, comprises cathodes K (R, G, B) including heaters, which are arranged in line in the horizontal direction X; a first grid G1; a second grid G2; a third grid G3; a fourth grid G4; a fifth grid G5 (first focus electrode); a sixth grid G6 (second focus electrode); a first intermediate electrode GM1; a second intermediate electrode GM2; a seventh grid G7 (anode), and a convergence cup G8.

The three cathodes K and the nine grids are arranged in succession in a direction of travel of electron beams and fixed by insulated support members (not shown). The convergence cup G8 is fixed to the seventh grid G7 by welding. The convergence cup G8 is equipped with four contacts for electrical connection with an internal conductor film coated on the area extending from the inner surface of funnel 2 to the inner surface of neck 5.

The three cathodes K (R, G, B) are supplied with a voltage of about 100V to 150V. The first grid G1 is grounded. The second grid G2 is supplied with an acceleration voltage Ec2 of about 600V to 800V from the outside of the CRT.

The third grid G3 and fifth grid G5 are connected within the tube and supplied with a focus voltage Ec3 of about 6 kV to 9 kV from the outside of the CRT. The sixth grid G6 is supplied with a dynamic focus voltage from the outside of the CRT. The dynamic focus voltage is obtained by superimposing an AC voltage component varying in synchronism with the deflection magnetic fields upon a focus voltage Ec6 of about 6 kV to 9 kV.

The seventh grid G7 and convergence cup G8 are supplied with an anode voltage Eb of about 25 kV to 30 kV from the outside of the CRT.

As is shown in FIG. 8, a resistor R is disposed near the electron gun assembly 7. One end A of the resistor R is connected to the seventh grid G7, and the other end C thereof is grounded on the outside of the tube.

The resistor R is connected to the fourth grid G4 at an intermediate portion B1 thereof. The fourth grid G4 is connected to the first intermediate electrode GM1 within the tube. Thereby, the fourth grid G4 and first intermediate electrode GM1 are supplied with a voltage equal to about 20% to 40% of the voltage applied to the seventh grid G7.

The resistor R is connected to the second intermediate electrode GM2 at an intermediate portion B2 thereof. Thereby, the second intermediate electrode GM2 is supplied with a voltage equal to about 50% to 70% of the voltage applied to the seventh grid G7.

The cathodes K (R, G, B) arranged in line are disposed with regular intervals of about 5 mm.

Each of the first grid G1 and second grid G2 is a thin-plate electrode and has, in its plate face, three small-diameter circular electron beam passage holes, each having a diameter of 1 mm or less.

The third grid G3 is formed by coupling a pair of cup-shaped electrodes which extend in the tube axis direction Z. The end face of the cup-shaped electrode facing the second grid G2 has three relatively large electron beam passage holes, each having a diameter of about 2 mm. The end face of the cup-shaped electrode facing the fourth grid G4 has three circular large-diameter electron beam passage holes, each having a diameter of about 3 mm to 6 mm.

The fourth grid G4 is formed by coupling a pair of cup-shaped electrodes. The end face of each cup-shaped electrode has three circular large-diameter electron beam passage holes, each having a diameter of about 3 mm to 6 mm.

The fifth grid G5 is formed by coupling a plurality of cup-shaped electrodes. The end face of each cup-shaped electrode has three circular large-diameter electron beam passage holes, each having a diameter of about 3 mm to 6 mm. The face of the fifth grid G5, which is opposed to the sixth grid G6, has three non-circular electron beam passage holes that are elongated in the vertical direction Y. Each non-circular electron beam passage hole, for example, is formed in a rectangular shape with longer sides in the vertical direction Y.

The sixth grid G6 is formed by coupling a plurality of cup-shaped electrodes. The face of the sixth grid G6, which is opposed to the fifth grid G5, has three non-circular electron beam passage holes that are elongated in the horizontal direction X. Each non-circular electron beam passage hole, for example, is formed in a rectangular shape with longer sides in the horizontal direction X. An end face G6B of the cup-shaped electrode of sixth grid G6, which is opposed to the first intermediate electrode GM1, has three circular large-diameter electron beam passage holes, each having a diameter of about 3 mm to 6 mm. In addition, the face of the sixth grid G6, which is opposed to the first intermediate electrode GM1, is provided with an outer peripheral electrode G6A defining an opening portion for commonly passing three electron beams, which have passed through the three electron beam passage holes. The outer peripheral electrode G6A extends from the end face G6B toward the first intermediate electrode GM1.

The first intermediate electrode GM1 is formed of a cup-shaped electrode. The end face of the first intermediate electrode GM1, which is opposed to the sixth grid G6, has an outer peripheral electrode GM1A defining an opening portion for commonly passing three electron beams. The end face of the first intermediate electrode GM1, which is opposed to the second intermediate electrode GM2, has three circular large-diameter electron beam passage holes, each having a diameter of about 3 mm to 6 mm.

The second intermediate electrode GM2 is formed of a thick plate-shaped electrode. The plate-shaped electrode has three circular large-diameter electron beam passage holes for respectively passing the three electron beams. Each hole has a diameter of about 3 mm to 6 mm.

The seventh grid G7 comprises a plate-shaped electrode and a plurality of cup-shaped electrodes. The plate-shaped electrode of the seventh grid G7, which is opposed to the second intermediate electrode GM2, has three circular large-diameter electron beam passage holes for respectively passing the three electron beams. Each hole has a diameter of about 3 mm to 6 mm. The end face of the cup-shaped electrode disposed adjacent to the plate-shaped electrode has three non-circular electron beam passage holes that are elongated in the horizontal direction X. Each non-circular electron beam passage hole, for example, is formed in an oval shape with a major axis in the horizontal direction X.

The convergence cup G8 is welded to the seventh grid G7. The end face of the convergence cup G8 has three circular large-diameter electron beam passage holes, each having a diameter of about 3 mm to 6 mm.

The first grid G1 and second grid G2 are opposed to each other with a very small distance of 0.5 mm or less. The second grid G2 to seventh grid G7 are arranged and opposed to each other with intervals of about 0.5 mm to 1 mm.

In the electron gun assembly 7 with the above-described structure, the cathodes K, first grid G1 and second grid G2 constitute an electron beam generating section for generating electron beams. The second grid G2 and third grid G3 constitute a prefocus lens for prefocusing the electron beams emitted from the electron beam generating section.

The third grid G3, fourth grid G4 and fifth grid G5 constitute a sub-lens for further focusing the electron beams, which have been prefocused by the prefocus lens. The fifth grid G5 and sixth grid G6 constitute a quadrupole lens, which is created in synchronism with the deflection of electron beams.

The fifth grid G5 (first focus electrode), sixth grid G6 (second focus electrode), first intermediate electrode GM1, second intermediate electrode GM2 and seventh grid G7 (anode) constitute a main lens section for ultimately focusing the electron beams on the phosphor screen. The main lens section is a combination of an overlapping field type lens and an extended field type lens.

As is shown in FIG. 8, the main lens section includes an electric field lens L1 on a focus region side of the main lens section, which is formed by sixth grid G6 and first intermediate electrode GM1. The electric field lens L1 acts commonly on the three electron beams. The electric field lens L1 is created by the outer peripheral electrodes provided on the opposing faces of the sixth grid G6 and first intermediate electrode GM1. In this manner, the electric field lens acting commonly on the three electron beams is formed by forming the opposing faces of the sixth grid G6 and first intermediate electrode GM1 in similar shapes with the outer peripheral electrodes.

In addition, the main lens section includes three electric field lenses L2 respectively acting on three electron beams on a divergence region side of the main lens section, which is formed by the second intermediate electrode GM2 and seventh grid G7. The electric field lenses L2 are created by the three electron beam passage holes which respectively pass the three electron beams and are formed in the opposing faces of the second intermediate electrode GM2 and seventh grid G7. Specifically, the opposing faces of the second intermediate electrode GM2 and seventh grid G7 have similar shapes, and the electric field lenses L2 are formed therebetween.

Each electric field lens L2 is an axially asymmetric lens. Specifically, the electric field lenses L2 are created by the structural feature that the electron beam passage holes for respectively passing three electron beams, which are formed in the electrode of the seventh grid G7, are formed in a horizontally elongated asymmetric shape. Each electric field lens L2 has, in a relative fashion, a focusing lens function in the horizontal direction X and a diverging lens function in the vertical direction Y.

Figures 9A, 9B:
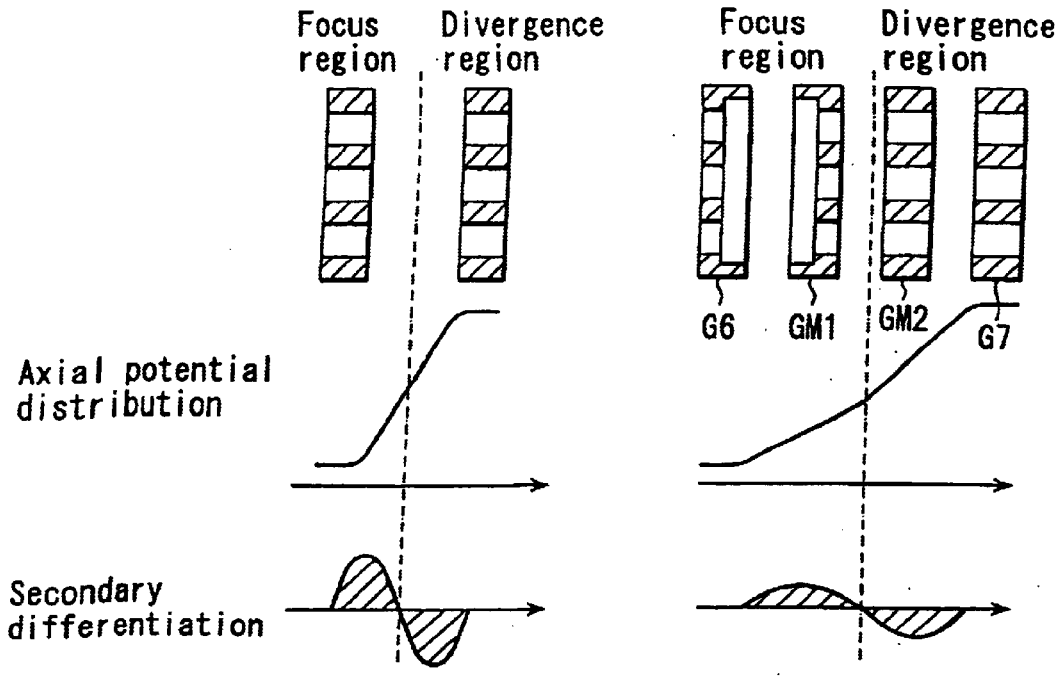
FIG. 9A (PRIOR ART) FIG. 9B
FIG. 9A shows an axial potential distribution of the main lens in the conventional electron gun assembly.
FIG. 9B shows an axial potential distribution of the main lens section in the electron gun assembly shown in FIG. 8.

As regards the main lens section with the above structure, the axial potential distribution can be made gentler. As is understood from secondary differentiation of the axial potential distribution, as shown in FIG. 9B, the axial potential distribution can be made gentler, compared to a prior-art structure shown in FIG. 9A. Thus, by adopting the extended field type lens in the main lens section, it is possible to obtain a large-diameter main lens in which the axial potential distribution increases gradually. In addition, by using the overlapping field type lens, the axial potential distribution on the focus region side can have a still gentler gradient. Accordingly, a large-diameter lens with a less aberration component can be realized.

In general terms, the overlapping field type main lens using the outer peripheral electrode has a negative astigmatism component. An electron beam, which has passed through the overlapping field type main lens, is horizontally under-focused and vertically over-focused. In this embodiment, in order to correct the focusing, the three electric field lenses individually acting on the three electron beams are formed between the second intermediate electrode GM2 and seventh grid G7, which are disposed on the divergence region side of the main lens section. The three electric field lenses have positive astigmatism components and are formed to have a horizontal focusing function and a vertical diverging function relatively.

Thus, there is no need to make the electron beam passage holes, which are formed in the electrode with the outer peripheral electrode, extremely longer in the vertical direction. In other words, there is no need to make the electron beam passage holes, which are formed in the electrode with the outer peripheral electrode, extremely shorter in the horizontal direction, and the effect of local aberration can be prevented from acting on the electron beams in this region.

In the conventional electron gun assembly, when the intermediate electrode is disposed adjacent to the electrode supplied with a dynamic focus voltage, part of the AC component of the dynamic focus voltage is superimposed on the intermediate electrode due to an inter-electrode capacitance. By contrast, according to the present embodiment, the outer peripheral electrodes are provided on the opposing faces of the sixth grid G6 supplied with the dynamic focus voltage and the first intermediate electrode GM1 disposed adjacent to the sixth grid.

Accordingly, the distance in the tube axis direction Z between the plate face of the sixth grid G6 and the plate face of the first intermediate electrode GM1, which produce the capacitance, is increased. This reduces the capacitance between the sixth grid G6 and first intermediate electrode GM1, and weakens the phenomenon that part of the AC component of the dynamic focus voltage is superimposed on the first intermediate electrode GM1.

As described above, the ratio of the dynamic focus voltage superimposed on the first intermediate electrode GM1 is decreased. Thereby, compared to the non-deflection mode in which the electron beam is focused on the central portion of the screen, the principal plane of the main lens section shifts toward the phosphor screen in the deflection mode in which the electron beam is deflected onto a peripheral portion of the screen. Therefore, the magnification of the main lens section in the deflection mode becomes less than in the non-deflection mode, and the beam spot size at the peripheral portion of the screen is improved and reduced.

The main lens section comprises the combination of the overlapping field type lens and extended field type lens. The main lens section includes an electric field lens acting commonly on the three electron beams on the focus region side of the main lens section. The main lens section also includes a plurality of electric field lenses acting respectively on the three electron beams on the diversion region side of the main lens section. The electric field lenses on the diversion region side are axially asymmetric lenses which have a horizontal focusing function and a vertical diverging function relatively.

Thus, a large-diameter main lens section can be formed, and the effect of aberration locally acting on the electron beams in the horizontal direction can be reduced. Moreover, the limitation to the length of the outer peripheral electrode due to the negative astigmatism of the main lens section can be eliminated. Besides, the ratio of the dynamic focus voltage superimposed on the intermediate electrode can be reduced, and a good beam spot can be formed over the entire area of the screen.

Figure 10:
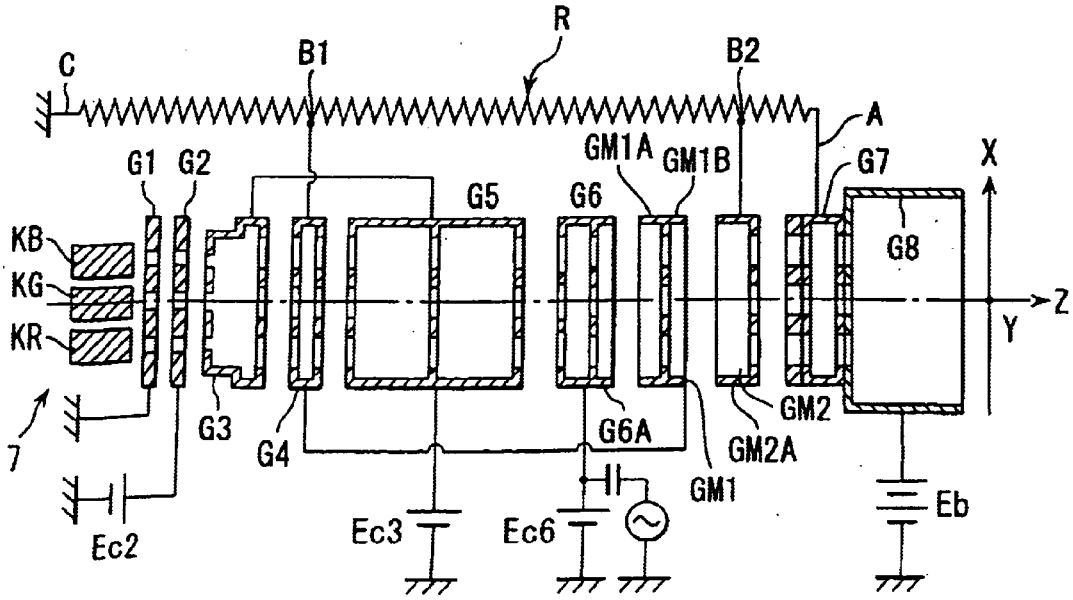
FIG. 10 is a horizontal cross-sectional view schematically showing another structure of the electron gun assembly applied to the CRT apparatus shown in FIG. 7.

In the above embodiment, as shown in FIG. 8, the second intermediate electrode GM2 has no outer peripheral electrode. Alternatively, as shown in FIG. 10, an outer peripheral electrode GM2A may be provided on the face of the second intermediate electrode GM2, which is opposed to the first intermediate electrode GM1. In addition, outer peripheral electrodes GM1A and GM1B may be provided on those faces of the first intermediate electrode GM1, which are opposed to the sixth grid G6 and second intermediate electrode GM2. With this structure, a lens with a still greater diameter can be realized.

In the above-described embodiments, the first intermediate electrode GM1 and fourth grid G4 are connected. Alternatively, the second grid G2 and fourth grid G4, for instance, may be connected.

In the above embodiments, the main lens section includes two intermediate electrodes and comprises a combination of an overlapping field type lens and an extended field type lens. Alternatively, the main lens section includes, for example, at least one intermediate electrode and comprises a combination of an overlapping field type lens and an extended field type lens. Furthermore, the present invention is applicable to an electron gun assembly having an ordinary bi-potential main lens or a uni-potential main lens.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising:

an electron gun assembly having an electron beam generating section which generates a plurality of electron beams and a main lens section which focuses the electron beams generated from the electron beam generating section on a phosphor screen; and a deflection yoke which produces a deflection magnetic field that deflects the electron beams emitted from the electron gun assembly in a horizontal direction and a vertical direction, wherein the main lens section comprises a focus electrode supplied with a focus voltage of a first level, at least one intermediate electrode supplied with a voltage of a second level equal to or higher than the first level, and an anode supplied with an anode voltage of a third level higher than the second level, the focus electrode, said at least one intermediate electrode and the anode being arranged in a direction of travel of the electron beams, and the main lens section includes an electric field lens acting commonly on the electron beams on a focus region side of the main lens section, which is formed by the focus electrode and said at least one intermediate electrode, and a plurality of electric field lenses acting respectively on the electron beams on a divergence region side of the main lens section, which is formed by said at least one intermediate electrode and the anode.

2. A cathode ray tube apparatus according to claim 1, wherein said focus electrode and said at least one intermediate electrode have, at their mutually opposing faces, outer peripheral electrodes defining opening portions which commonly pass the electron beams.

3. A cathode ray tube apparatus according to claim 1, wherein said at least one intermediate electrode and said anode have, at their mutually opposing faces, a plurality of electron beam passage holes which individually pass the electron beams.

4. A cathode ray tube apparatus according to claim 3, wherein each of said plurality of electron beam passage holes formed in the anode is formed in a non-circular shape with a major axis in the horizontal direction.

5. A cathode ray tube apparatus according to claim 1, wherein said plurality of electric field lenses formed on the divergence region side of the main lens section are axially asymmetric lenses.

6. A cathode ray tube apparatus according to claim 5, wherein said axially asymmetric lenses have, in a relative fashion, a horizontal focusing lens function and a vertical diverging lens function.

7. A cathode ray tube apparatus according to claim 1, wherein said main lens section comprises a focus electrode, a first intermediate electrode, a second intermediate electrode and an anode, which are arranged in a direction of travel of the electron beams, and the electric field lens acting commonly on the electron beams is formed by the focus electrode and the first intermediate electrode, and said plurality of electric field lenses acting respectively on the electron beams are formed by the second intermediate electrode and the anode.

8. A cathode ray tube apparatus according to claim 1, wherein said at least one intermediate electrode is connected to a resistor disposed near the electron gun assembly and supplied with a voltage obtained by resistor-dividing the anode voltage applied to the anode.

9. A cathode ray tube apparatus according to claim 1, wherein said focus electrode has a first focus electrode supplied with a reference voltage, and a second focus electrode supplied with a dynamic focus voltage obtained by superimposing upon the reference voltage an AC component varying in synchronism with the deflection magnetic field.

10. A cathode ray tube apparatus according to claim 9, wherein said second focus electrode and the intermediate electrode disposed adjacent to the second focus electrode have, at their mutually opposing faces, outer peripheral electrodes defining opening portions which commonly pass the electron beams.

11. A cathode ray tube apparatus comprising:

an electron gun assembly having an electron beam generating section which generates a plurality of electron beams and a main lens section which focuses the electron beams generated from the electron beam generating section on a phosphor screen; and a deflection yoke which produces a deflection magnetic field that deflects the electron beams emitted from the electron gun assembly in a horizontal direction and a vertical direction, wherein the main lens section comprises a focus electrode supplied with a focus voltage of a first level, at least one intermediate electrode supplied with a voltage of a second level equal to or higher than the first level, and an anode supplied with an anode voltage of a third level higher than the second level, the focus electrode, said at least one intermediate electrode and the anode being arranged in a direction of travel of the electron beams, said focus electrode has, in a face thereof opposed to the intermediate electrode disposed adjacent to the focus electrode, an electron beam passage hole which commonly passes the electron beams, and said anode has, in a face thereof opposed to the intermediate electrode disposed adjacent to the anode, a plurality of electron beam passage holes which individually pass the electron beams.

12. A cathode ray tube apparatus according to claim 11, wherein said intermediate electrode opposed to the focus electrode has, in a face thereof opposed to the focus electrode, an electron beam passage hole which commonly passes the electron beams, and said intermediate electrode opposed to the anode has, in a face thereof opposed to the anode, a plurality of electron beam passage holes which individually pass the electron beams.

13. A cathode ray tube apparatus according to claim 11, wherein the focus voltage applied to the focus electrode is obtained by superimposing upon a reference voltage an AC component varying in synchronism with the deflection magnetic field.

14. A cathode ray tube apparatus according to claim 11, wherein the focus electrode includes an end face located on the side of the intermediate electrode disposed adjacent to the focus electrode and having a plurality of electron beam passage holes which individually pass the electron beams, and an outer peripheral electrode extending from said end face toward the intermediate electrode disposed adjacent to the focus electrode and forming an electron beam passage hole which commonly passes the electron beams.

* * * * *